US007575838B2

(12) United States Patent
Wu et al.

(10) Patent No.: US 7,575,838 B2
(45) **Date of Patent: *Aug. 18, 2009**

(54) IMAGING MEMBERS AND METHOD FOR SENSITIZING A CHARGE GENERATION LAYER OF AN IMAGING MEMBER

(75) Inventors: Jin Wu, Webster, NY (US); Geoffrey M. T. Foley, Fairport, NY (US); Satchidanand Mishra, Webster, NY (US); Liang-bih Lin, Rochester, NY (US); Anthony M. Horgan, Pittsford, NY (US); Yonn K. Rasmussen, Pittsford, NY (US); Kathleen M. Carmichael, Williamson, NY (US); Edward F. Grabowski, Webster, NY (US); Markus Rudolf Silvestri, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 403 days.

This patent is subject to a terminal disclaimer.

(21) Appl. No.: 11/481,729

(22) Filed: Jul. 6, 2006

(65) Prior Publication Data

US 2008/0008948 A1 Jan. 10, 2008

(51) Int. Cl.
*G03G 5/047* (2006.01)

(52) U.S. Cl. ..... 430/57.1; 430/58.05; 430/58.35; 430/58.65; 430/58.85; 430/59.4; 430/135

(58) Field of Classification Search ..... 430/57.1, 430/58.05, 58.35, 58.65, 58.85, 59.4
See application file for complete search history.

(56) References Cited

U.S. PATENT DOCUMENTS

| | | | | |
|---|---|---|---|---|
| 4,233,384 | A | 11/1980 | Turner et al. | 430/58.75 |
| 4,265,990 | A | 5/1981 | Stolka et al. | 430/58.8 |
| 4,299,897 | A | 11/1981 | Stolka et al. | 430/58.8 |
| 4,306,008 | A | 12/1981 | Pai et al. | 430/58.8 |
| 4,346,158 | A | 8/1982 | Pai et al. | 430/58.8 |
| 4,439,507 | A | 3/1984 | Pan et al. | 430/58.8 |
| 4,464,450 | A | 8/1984 | Teuscher | 430/58.8 |
| 4,921,773 | A | 5/1990 | Melnyk et al. | 430/132 |
| 5,153,094 | A | 10/1992 | Kazmaier et al. | 430/135 |
| 5,166,339 | A | 11/1992 | Duff et al. | 540/141 |
| 5,189,155 | A | 2/1993 | Mayo et al. | 540/141 |
| 5,189,156 | A | 2/1993 | Mayo et al. | 540/141 |
| 5,350,654 | A | 9/1994 | Pai et al. | 430/58.2 |
| 5,473,064 | A | 12/1995 | Mayo et al. | 540/141 |
| 5,482,811 | A | 1/1996 | Keoshkerian et al. | 430/135 |
| 5,521,306 | A | 5/1996 | Burt et al. | 540/141 |
| 6,063,533 | A | 5/2000 | Yanus et al. | 430/58.75 |
| 6,350,550 | B1 | 2/2002 | Mishra et al. | 430/56 |
| 7,445,876 | B2 * | 11/2008 | Wu et al. | 430/58.75 |
| 7,498,108 | B2 * | 3/2009 | Wu et al. | 430/59.1 |
| 2004/0126687 | A1 * | 7/2004 | Ikegami et al. | 430/58.75 |
| 2005/0042533 | A1 * | 2/2005 | Wu et al. | 430/64 |
| 2007/0292786 | A1 * | 12/2007 | Wu et al. | 430/58.8 |
| 2007/0292793 | A1 * | 12/2007 | Wu et al. | 430/58.8 |

OTHER PUBLICATIONS

U.S. Patent Application filed Jun. 6, 2006, of Jin Wu et al., entitled "Imaging Members and Method for Sensitizing a Charge Generation Layer of An Imaging Member" 36 pages, not yet published.

U.S. Appl. No. 10/992,500, filed Nov. 18, 2004, of Jin Wu et al., entitled "Processes For The Preparation Of High Sensitivity Titanium Phthalocyanines Photogenerating Pigments", published May 18, 2006.

U.S. Patent Application entitled "Photoreceptor Layer Having Thiophosphate Lubricants", 21 pages, not yet published.

U.S. Patent Application filed Jun. 6, 2006, of Jin Wu et al., entitled "Imaging Members and Method for Sensitizing a Charge Generation Layer of An Imaging Member" 38 pages, not yet published.

U.S. Patent Application filed Jun. 6, 2006, of Jin Wu et al., entitled "Electrophotographic Imaging Member Undercoat Layers" 57 pages, not yet published.

* cited by examiner

*Primary Examiner*—Hoa V Le
(74) *Attorney, Agent, or Firm*—Marylou J. Lavoie, Esq. LLC

(57) ABSTRACT

An imaging member including a substrate; thereover a charge generation layer comprising a thiophosphate; and at least one charge transport layer positioned on the charge generation layer.

16 Claims, No Drawings

IMAGING MEMBERS AND METHOD FOR SENSITIZING A CHARGE GENERATION LAYER OF AN IMAGING MEMBER

CROSS-REFERENCE TO RELATED APPLICATIONS

Illustrated in U.S. Ser. No. 11/481,762, of Jin Wu et al., filed Jul. 6, 2006, entitled "Imaging Members and Method for Sensitizing a Charge Generation Layer of an Imaging Member," the disclosure of which is totally incorporated herein by reference, is, in embodiments, an imaging member including a substrate; an optional undercoat layer; a charge generation layer comprising photoconductive pigment such as phthalocyanine and a pigment sensitizing dopant having an electron acceptor molecule; and a charge transport layer.

Illustrated in U.S. Ser. No. 11/481,730, of Jin Wu et al., filed Jul. 6, 2006, entitled "Imaging Members and Method for Sensitizing a Charge Generation Layer of an Imaging Member," the disclosure of which is totally incorporated herein by reference, is in embodiments, an imaging member comprising a substrate; an optional undercoat layer; a charge generation layer comprising photoconductive pigment such as rylene and a pigment sensitizing dopant comprising in embodiments an electron acceptor molecule, in embodiments, tetracyanoethylene; and a charge transport layer.

Illustrated in U.S. Ser. No. 11/481,731, of Jin Wu et al., filed Jul. 6, 2006, entitled "Electrophotographic Imaging Member Undercoat Layers," the disclosure of which is totally incorporated herein by reference, is in embodiments, an imaging member including a substrate; a charge generation layer positioned on the substrate; at least one charge transport layer positioned on the charge generation layer; and an undercoat layer positioned on the substrate on a side opposite the charge generation layer, the undercoat layer comprising a binder component, a metal oxide, and a thiophosphate.

Illustrated in U.S. Ser. No. 11/193,129, of Jin Wu et al., filed Jul. 28, 2005, entitled "Photoreceptor Layer Having Thiophosphate Lubricants" the disclosure of which is totally incorporated herein by reference, is, in embodiments, an imaging member containing a substrate, and an outer layer containing a thiophosphate, and an image forming apparatus for forming images on a recording medium including the imaging member above, a development component to apply a developer material to said charge-retentive surface to develop said electrostatic latent image to form a developed image on said charge-retentive surface; a transfer component for transferring said developed image from said charge-retentive surface to another member or a copy substrate; and a fusing member to fuse said developed image to said copy substrate.

BACKGROUND

The present disclosure is generally related to imaging members, also referred to as photoreceptors, photosensitive members, and the like, and in embodiments to methods of treating the charge generation layer of electrophotographic imaging members. The imaging members may be used in copier, printer, fax, scanner, multifunction machines, and the like. In embodiments, the methods reduce scratching, abrasion, corrosion, fatigue, and cracking, and facilitate cleaning and durability of devices, for example active matrix imaging devices, such as active matrix belts.

In the art of electrophotography, a photoreceptor, imaging member, or the like, comprising a photoconductive insulating layer on a conductive layer is imaged by first uniformly electrostatically charging the surface of the photoconductive insulating layer. The photoreceptor is then exposed to a pattern of activating electromagnetic radiation such as light, which selectively dissipates the charge in the illuminated areas of the photoconductive insulating layer while leaving behind an electrostatic latent image in the non-illuminated areas. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Electrophotographic imaging members or photoreceptors are usually multilayered photoreceptors that comprise a substrate support, an electrically conductive layer, an optional hole blocking layer, an optional adhesive layer, a charge generation layer, and a charge transport layer in either a flexible belt form or a rigid drum configuration. Multilayered flexible photoreceptor members may include an anti-curl layer on the backside of the substrate support, opposite to the side of the electrically active layers, to render the desired photoreceptor flatness.

Examples of photosensitive members having at least two electrically operative layers including a charge generating layer and diamine containing transport layer are disclosed in U. S. Pat. Nos. 4,265,990; 4,233,384; 4,306,008; 4,299,897; and 4,439,507, the disclosures of each of which are hereby incorporated by reference herein in their entireties.

Photoreceptors can also be single layer devices. For example, single layer organic photoreceptors typically comprise a photogenerating pigment, a thermoplastic binder, and hole and electron transport materials.

As more advanced, higher speed electrophotographic copiers, duplicators and printers were developed, the performance requirements for the xerographic components increased. Moreover, complex, highly sophisticated, duplicating and printing systems employing flexible photoreceptor belts, operating at very high speeds, have also placed stringent mechanical requirements and narrow operating limits as well on photoreceptors.

The charge generation layer is capable of photogenerating holes and injecting the photogenerated holes into the charge transport layer. The charge generation layer used in multilayered photoreceptors include, for example, inorganic photoconductive particles or organic photoconductive particles dispersed in a film forming polymeric binder. Inorganic or organic photoconductive material may be formed as a continuous, homogenous charge generation section. Many suitable photogenerating materials known in the art may be used, if desired.

Electrophotographic imaging members or photoreceptors having varying and unique properties are needed to satisfy the vast demands of the xerographic industry. The use of organic/inorganic photogenerating pigments such as phthalocyanines, perylenes, bisazos, perinones, and polycyclic quinines in electrophotographic applications is well known. Generally, layered imaging members with the aforementioned pigments exhibit acceptable photosensitivity.

However, faster pigments are desired for future photoreceptor device designs as process speeds increase.

There is remains a need to straightforwardly adjust pigment sensitivities. The ability to tailor sensitivities has been previously demonstrated to be a valuable capability by involving the mixing of high and low sensitivity pigments. The problem is to find a common polymeric binder to disperse two pigments with excellent dispersion quality.

Common print quality issues are strongly dependent on the quality of the charge generation layer. For example, charge deficient spots and bias charge roll leakage breakdown are problems that commonly occur. Another problem is imaging ghosting which is thought to result from the accumulation of charge somewhere in the photoreceptor. Consequently, when a sequential image is printed, the accumulated charge results in image density charges in the current printed image that reveals the previously printed image.

U.S. Pat. No. 6,350,550, which is incorporated by reference herein in its entirety, describes in the Abstract thereof a charge generation section of an electrophotographic imaging member having hydroxygallium phthalocyanine photoconductive pigment and benzimidazole perylene photoconductive pigment in a solvent solution comprising a film forming polymer or copolymer dissolved in a solvent.

U.S. Pat. No. 6,063,553, which is incorporated by reference herein in its entirety, describes in the Abstract thereof an electrophotographic imaging member including a supporting substrate; an undercoat layer; a charge generation layer comprising photoconductive pigment particles, film forming binder and a charge transport layer formed from a coating solution, the coating solution comprising charge transporting molecules, the charge transporting molecules comprising a major amount of a first charge transport molecule comprising an alkyl derivative of an arylamine and a minor amount of second transport molecule comprising an alkyloxy derivative of an arylamine, the charge generation layer being located between the substrate and the charge transport layer. A process for fabricating this imagine member is also disclosed.

U.S. Pat. No. 5,350,654, which is incorporated by reference herein in its entirety, describes in the Abstract thereof a layered photoreceptor composed of a substrate, an extrinsic pigment layer that has been sensitized disposed over the substrate, and a charge transport polymer in contact with the pigment layer. A method for producing a photoreceptor comprises depositing a layer of sensitizing electron donor material in a polymer binder on a substrate. An extrinsic pigment layer is deposited on the layer of sensitizing electron donor material. A charge transport layer is deposited on the pigment layer.

The appropriate components and process aspects of the each of the foregoing U.S. Patents may be selected for the present disclosure in embodiments thereof.

SUMMARY

Embodiments disclosed herein include an imaging member comprising a substrate; thereover a charge generation layer comprising a thiophosphate; and at least one charge transport layer positioned on the charge generation layer.

Embodiments disclosed herein further include a process for fabricating an imaging member comprising providing a substrate; forming an optional undercoat layer on the substrate; forming an optional adhesive layer situated on the substrate or on the optional blocking layer; forming a sensitized charge generation layer comprising a thiophosphate on the substrate, on the optional undercoat layer, or on the optional adhesive layer; and forming at least one charge transport layer on the charge generation layer. In embodiments, for example, the charge generation layer comprises a photoconductive pigment, a polymeric resin and thiophosphate.

Embodiments disclosed herein further include a process for fabricating an imaging member exhibiting low imaging ghosting.

Embodiments disclosed herein further include a process for fabricating an imaging member exhibiting tunable sensitivity with incorporating a thiophosphate into a charge generation layer.

Further embodiments disclosed herein include an imaging member comprising a substrate; a charge generation layer positioned on the substrate, wherein the charge generation layer comprises zinc dialkyldithiophosphate; and; at least one charge transport layer positioned on the charge generation layer.

In addition, embodiments disclosed herein an image forming apparatus for forming images on a recording medium comprising a) a photoreceptor member having a charge retentive surface to receive an electrostatic latent image thereon, wherein said photoreceptor member comprises a metal or metallized substrate, a charge generation layer, and at least one charge transport layer; wherein the charge generation layer comprises a thiophosphate; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

DETAILED DESCRIPTION

Embodiments disclosed herein include a process for fabricating an imaging member comprising providing a substrate; forming an optional undercoat layer on the substrate; forming an optional adhesive layer situated on the substrate or on the optional blocking layer; forming a sensitized charge generation layer comprising a thiophosphate on the substrate, on the optional undercoat layer, or on the optional adhesive layer; and forming at least one charge transport layer on the charge generation layer. In embodiments, for example, the charge generation layer comprises a photoconductive pigment, a polymeric resin and thiophosphate.

Embodiments disclosed herein further include a process for fabricating an imaging member exhibiting low imaging ghosting.

Embodiments disclosed herein further include a process for fabricating an imaging member exhibiting tunable sensitivity with incorporating a thiophosphate into a charge generation layer.

In embodiments, the thiophosphate component comprises a metal free or non-metal containing thiophosphate or a metal thiophosphate. In embodiments, the metal is selected from the group consisting of, but not limited to, zinc, molybdenum, lead, manganese, and antimony, and mixtures and combinations thereof. For example, in various selected embodiments, the thiophosphate comprises a metal thiophosphate selected from the group consisting of zinc thiophosphate, molybdenum thiophosphate, lead thiophosphate, antimony thiophosphate, manganese thiophosphate, and mixtures and combinations thereof.

In embodiments, the thiophosphate is selected from the group consisting of materials having the following structures (1)

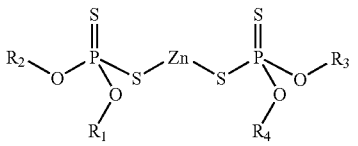

wherein $R_1$, $R_2$, $R_3$, $R_4$, $R_5$ and $R_6$ are each independently selected form the group consisting of hydrogen, an alkyl group having from about 1 to about 20 carbon atoms, a cycloalkyl group having form about 6 to about 26 carbon atoms, aryl, aklylaryl, arylaklyl, or a hydrocarbyl group having form about 3 to about 20 carbon atoms and containing an ester, ether, alcohol or carboxyl group, a straight chained alkyl group having from about 2 to about 18 carbon atoms, a branched alkyl group having from about 2 to about 18 carbon atoms, or mixtures or combinations thereof.

For example, in embodiments, an imaging member is disclosed wherein the thiophosphate comprises metal dialkyldithiophosphate, for example zinc dialkyldithiophosphate. Specific examples of metal dialkyldithiophosphates include molybdenum di(2-ethylhexyl)dithiophosphate, zinc diethyldithiophosphate, antimony diamyldithiophosphate, and the like. Commercial zinc dialkyldithiophosphates include ELCO™ 102, 103, 108, 114, 111, and 121, available from Elco Corporation, Cleveland, Ohio. A number of the thiophosphates contain a certain amount of petroleum distillates, mineral oils such as ValPar™ 500, available from Valero Energy Corporation, San Antonio, Tex. Commercial molybdenum dialkyldithiophosphates include MOLYVAN™ L (molybdenum di(2-ethylhexyl)phosphorodithioate), available from R.T. Vanderbilt Company, Inc., Norwalk, Conn. Commercial antimony dialkyldithiophosphates include VANLUBE™ 622 and 648 (antimony dialkylphosphorodithioate), available from R.T. Vanderbilt Company, Inc., Norwalk, Conn.

In embodiments, the thiophosphate is present in an amount selected from about 0.1 weight percent to about 40 weight percent based upon the total weight of the charge generation layer.

The thiophosphates may also be added to each charge transport layer and/or to the undercoat layer, such as from about 0.01 to about 30 weight percent, from about 0.1 to about 10 weight percent, or from about 0.5 to about 5 weight percent in the charge transport layer or layers; and from about 0.1 to about 40 weight percent, from about 1 to about 20 weight percent, or from about 5 to about 15 weight percent in the undercoat layer. For example, in embodiments, at least one of the charge generation layer and the charge transport layer comprise thiophosphate, and wherein the thiophosphate is present in an amount of from about 0.01 to about 40 weight percent based on the weight of the charge generation layer, the charger transport layer, or a combined weight of the charger generation and charge transport layer.

Any suitable multilayer photoreceptor may be employed in present imaging member. The various layers may be applied in any suitable order to produce either positive or negative charging photoreceptors. For example, the charge generating layer may be applied prior to the charge transport layer, as illustrated in U.S. Pat. No. 4,265,990, which is hereby incorporated by reference herein in its entirety, or the charge transport layer may be applied prior to the charge generating layer, as illustrated in U.S. Pat. No. 4,346,158, which is hereby incorporated by reference herein in its entirety. In selected embodiments, the first pass charge transport layer is formed upon a charge generation layer and the second pass charge transport layer is formed upon the first pass charge transport layer.

The supporting substrate can be selected to include a conductive metal substrate or a metallized substrate. While a metal substrate is substantially or completely metal, the substrate of a metallized substrate is made of a different material that has at least one layer of metal applied to at least one surface of the substrate. The material of the substrate of the metallized substrate can be any material for which a metal layer is capable of being applied. For instance, the substrate can be a synthetic material, such as a polymer. In various exemplary embodiments, a conductive substrate is, for example, at least one member selected from the group consisting of aluminum, aluminized or titanized polyethylene terephthalate belt (Mylar®).

Any metal or metal alloy can be selected for the metal or metallized substrate. Typical metals employed for this purpose include aluminum, zirconium, niobium, tantalum, vanadium, hafnium, titanium, nickel, stainless steel, chromium, tungsten, molybdenum, mixtures and combinations thereof, and the like. Useful metal alloys may contain two or more metals such as zirconium, niobium, tantalum, vanadium, hafnium, titanium, nickel, stainless steel, chromium, tungsten, molybdenum, mixtures and combinations thereof, and the like. Aluminum, such as mirror-finish aluminum, is selected in embodiments for both the metal substrate and the metal in the metallized substrate. All types of substrates may be used, including honed substrates, anodized substrates, bohmite-coated substrates and mirror substrates.

A metal substrate or metallized substrate can be selected. Examples of substrate layers selected for the present imaging members include opaque or substantially transparent materials, and may comprise any suitable material having the requisite mechanical properties. Thus, for example, the substrate can comprise a layer of insulating material including inorganic or organic polymeric materials, such as Mylar®, a commercially available polymer, Mylar® containing titanium, a layer of an organic or inorganic material having a semiconductive surface layer, such as indium tin oxide or aluminum arrange thereon, or a conductive material such as aluminum, chromium, nickel, brass or the like. The substrate may be flexible, seamless, or rigid, and may have a number of different configurations. For example, the substrate may comprise a plate, a cylindrical drum, a scroll, and endless flexible belt, or other configuration. In some situations, it may be desirable to provide an anticurl layer to the back of the substrate, such as when the substrate is a flexible organic polymeric material, such as for example polycarbonate materials, for example Makrolon® a commercially available material.

Optionally, a hole blocking layer is applied, in embodiments, to the substrate. Generally, electron blocking layers for positively charged photoreceptors allow the photogenerated holes in the charge generating layer at the top of the photoreceptor to migrate toward the charge (hole) transport layer below and reach the bottom conductive layer during the electrophotographic imaging process. Thus, an electron blocking layer is normally not expected to block holes in positively charged photoreceptors such as photoreceptors coated with a charge generating layer over a charge (hole) transport layer. For negatively charged photoreceptors, any suitable hole blocking layer capable of forming an electronic barrier to holes between the adjacent photoconductive layer and the underlying substrate layer may be utilized. A hole blocking layer may comprise any suitable material. Typical hole blocking layers utilized for the negatively charged photoreceptors may include, for example, polyamides such as Luckamide® (a nylon-6 type material derived from methoxymethyl-substituted polyamide), hydroxyl alkyl methacrylates, nylons, gelatin, hydroxyl alkyl cellulose, organopolyphosphazenes, organosilanes, organotitanates, organozirconates, silicon oxides, zirconium oxides, zinc oxides, titanium oxides, and the like. In embodiments, the hole blocking layer comprises nitrogen containing siloxanes.

The blocking layer, as with all layers herein, may be applied by any suitable technique such as, but not limited to, spraying dip coating, draw bar coating, gravure coating, silk screening, air knife coating, reverse roll coating, vacuum deposition, chemical treatment, and the like.

An adhesive layer may optionally be applied such as to the hole blocking layer. The adhesive layer may comprise any suitable material, for example, any suitable film forming polymer. Typical adhesive layer materials include, but are not limited to, for example, copolyester resins, polyarylates, polyurethanes, blends of resins, and the like. Any suitable solvent may be selected in embodiments to form an adhesive layer coating solution. Typical solvents include, but are not limited to, for example, tetrahydrofuran, toluene, hexane, cyclohexane, cyclohexanone, methylene chloride, 1,1,2-trichloroethane, monochlorobenzene, and mixtures thereof, and the like.

The photogenerating or charge-generating component converts light input into electron hole pairs. Examples of compounds suitable for use as the charge-generating component include rylenes, benzimidazole perylene, vanadyl phthalocyanine, metal phthalocyanines (such as titanyl phthalocyanine, chlorogallium phthalocyanine, hydroxygallium phthalocyanine, and alkoxygallium phthalocyanine), metal-free phthalocyanines, amorphous selenium, trigonal selenium, selenium alloys (such as selenium-tellurium, selenium-tellurium arsenic, selenium arsenide), chlorogallium phthalocyanine, and mixtures and combinations thereof. In various exemplary embodiments, a charge generation layer includes rylenes. In various exemplary embodiments, a charge generation layer includes metal phthalocyanines and/or metal free phthalocyanines.

Rylenes have a backbone consisting of peri-linked naphthalene units of the following structure:

(3)

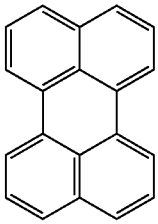

Examples of photogenerating rylenes include benzimidazole perylene (BZP) having the formula of (4)

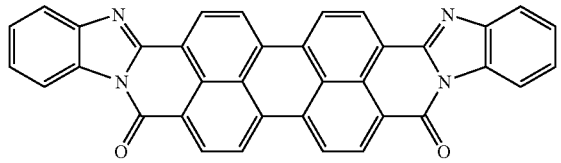

benzimidazole terrylene (BZT) having the formula of (5)

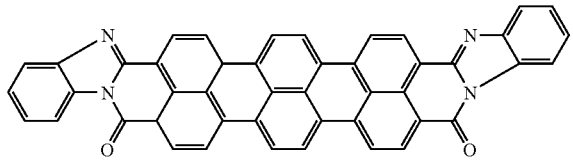

benzimidazole quaterrylene (BZQ) having the formula of (6)

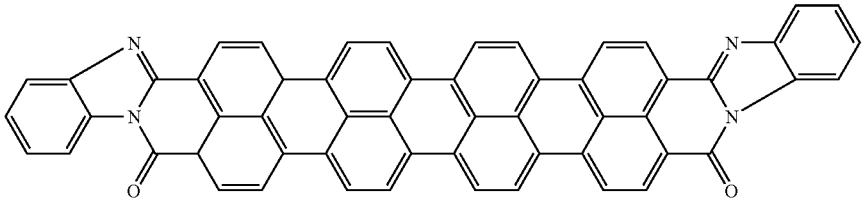

piperidine-modified benzimidazole terrylene (PBZT) having the formula of (7)

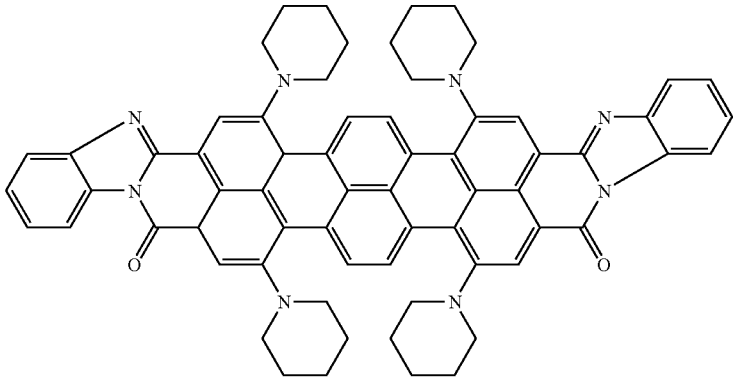

piperidine-modified benzimidazole perylene (PBZP) having the formula of (8)

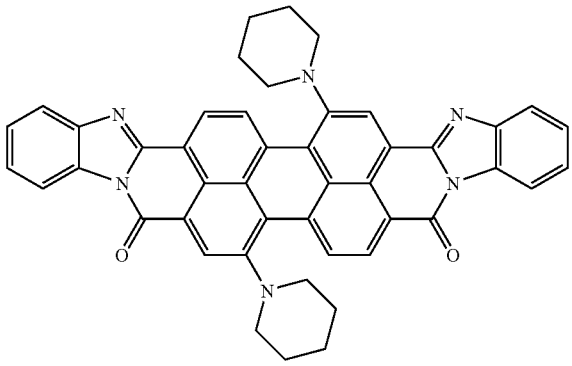

and piperidine-modified benzimidazole quaterrylene (PBZQ) having the formula of (9)

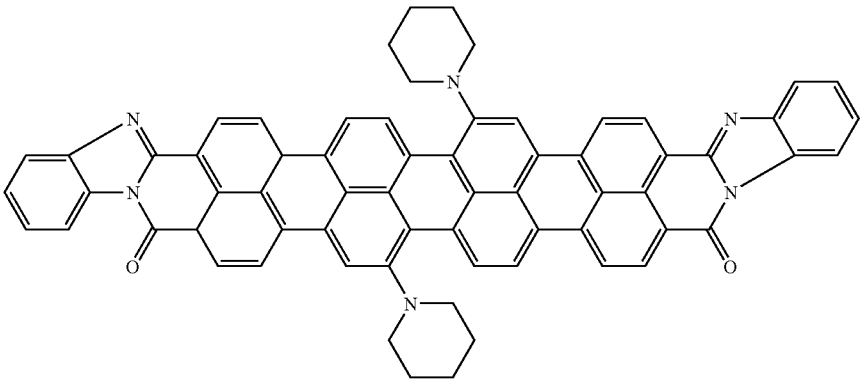

and the like and mixtures and combinations thereof.

Photogenerating rylene is most responsive at a range of, for example, from about 500 nanometers to about 1,500 nanometers and is generally unresponsive to the light spectrum below about 500 nanometers. Typical wavelengths for photogeneration may be from about 600 nanometers to about 1,200 nanometers and may include a broadband between the two wavelengths. Single wavelength exposure may be from about 650 nanometers to about 1,000 nanometers. Photogenerating benzimidazole perylene absorbs most light at a range of from about 650 to about 700.

In general, rylene absorption spectra can be red-shifted via changing the chemical structures: (1) increasing number of rylene units; (2) aryl amination; (2) introduction of piperidine substituents in the bay positions, etc. Photogenerating benzimidazole terrylene and benzimidazole quaterrylene absorb most light at longer wavelength than photogenerating benzimidazole perylene due to the presence of more peri-linked naphthalene units in their molecules. Furthermore, photogenerating piperidine-modified benzimidazole perylene, piperidine-modified benzimidazole terrylene and piperidine-modified benzimidazole quaterrylene absorb most light at longer wavelength than photogenerating benzimidazole perylene due to either the presence of more peri-linked naphthalene units in their molecules or/and piperidine substituents in the bay positions.

In various exemplary embodiments, a charge generation layer includes Type V hydroxygallium phthalocyanine, Type A, B or C chlorogallium phthalocyanine, Type IV titanyl phthalocyanine, or Type V titanyl phthalocyanine prepared as illustrated herein and in co-pending U.S. patent application Ser. No. 10/992,500 of Jin Wu et al., filed Nov. 11, 2004, the disclosure of which is totally incorporated herein by reference.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, present in an amount of from about 10 parts to about 100 parts or about 19 parts with 1,3-diiminoisoindolene ($DI^3$) in an amount of from about 1 part to about 10 parts or about 4 parts of $DI^3$, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts or about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week or about 24 hours.

A number of titanyl phthalocyanines, or oxytitanium phthalocyanines, are suitable photogenerating pigments known to absorb near infrared light around 800 nanometers and have generally exhibited improved sensitivity compared to other pigments such as, for example, hydroxygallium phthalocyanine. Generally, titanyl phthalocyanine is known to have five main crystal forms known as Types I, II, III, X, and IV. The various polymorphs of titanyl phthalocyanine have been demonstrated as suitable pigments in the charge or photogenerating layer of a photoimaging member or device. Various methods for preparing a titanyl phthalocyanine having a particular crystal phase have been demonstrated. For example, U.S. Pat. Nos. 5,189,155 and 5,189,156, the entire disclosures of which are incorporated herein by reference, disclose a number of methods for obtaining various polymorphs of titanyl phthalocyanine. Additionally, U.S. Pat. Nos. 5,189,155 and 5,189,156 are directed to processes for obtaining Type I, X, and IV phthalocyanines. U.S. Pat. No. 5,153,094, the entire disclosure of which is incorporated herein by reference, relates to the preparation of titanyl phthalocyanine polymorphs including Type I, II, III, and IV polymorphs. U.S. Pat. No. 5,166,339, the entire disclosure of which is incorporated herein by reference, discloses processes for preparing Type I, IV, and X titanyl phthalocyanine polymorphs, as well as the preparation of two polymorphs designated as Type Z-1 and Type Z-2.

With further respect to the titanyl phthalocyanines selected for the photogenerating layer such phthalocyanines exhibit a crystal phase that is distinguishable from other known titanyl phthalocyanine polymorphs, and are designated as Type V polymorphs. The processes generally comprises converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises: (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises an alkyl alcohol and an alkylene halide.

The process further provides a titanyl phthalocyanine having a crystal phase distinguishable from other known titanyl phthalocyanines. The titanyl phthalocyanine prepared by a process according to the present disclosure, which is designated as a Type V titanyl phthalocyanine, is distinguishable from, for example, Type IV titanyl phthalocyanines, in that a Type V titanyl phthalocyanine exhibits an x-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

Any Type I titanyl phthalocyanine may be selected as the starting material in the present process. Type I titanyl phthalocyanines suitable for use in the present process may be obtained by any suitable method. Examples of suitable methods for preparing Type I titanyl phthalocyanines include, but are not limited to, those disclosed in U.S. Pat. Nos. 5,153,094; 5,166,339; 5,189,155; and 5,189,156, the disclosures of which are totally incorporated herein by reference.

A Type I titanyl phthalocyanine may be prepared, in one embodiment by the reaction of $DI^3$ (1,3-diiminoisoindolene) and tetrabutoxide in the presence of 1-chloronaphthalene solvent, whereby there is obtained a crude Type I titanyl phthalocyanine, which is subsequently purified, up to about a 99.5 percent purity, by washing with, for example, dimethylformamide.

In another embodiment, for example, a Type I titanyl phthalocyanine can also be prepared by i) the addition of 1 part titanium tetrabutoxide to a stirred solution of from about 1 part to about 10 parts and, in embodiments, about 4 parts of 1,3-diiminoisoindolene; ii) relatively slow application of heat using an appropriate sized heating mantle at a rate of about 1 degree per minute to about 10 degrees per minute and, in embodiments, about 5 degrees per minute until refluxing occurs at a temperature of about 130 degrees to about 180 degrees (all temperatures are in Centigrade unless otherwise indicated); iii) removal and collection of the resulting distillate, which was shown by NMR spectroscopy to be butyl alcohol, in a dropwise fashion, using an appropriate apparatus such as a Claisen Head condenser, until the temperature of the reactants reaches from 190 degrees to about 230 degrees and, in embodiments, about 200 degrees; iv) continued stirring at the reflux temperature for a period of about ½ hour to about 8 hours and, in embodiments, about 2 hours; v) cooling of the reactants to a temperature of about 130 degrees to about 180 degrees, and, in embodiments about 160 degrees, by removal of the heat source; vi) filtration of the flask contents through, for example, an M-porosity (10 to 15 micron) sintered glass funnel which was preheated using a solvent which is capable of raising the temperature of the funnel to about 150 degrees, for example, boiling N,N-dimethylformamide in an amount sufficient to completely cover the bottom of the filter funnel so as to prevent blockage of said funnel; vii) washing the resulting purple solid by slurrying the solid in portions of boiling DMF either in the funnel or in a separate vessel in a ratio of about 1 to about 10 or about 3 times the volume of the solid being washed, until the hot filtrate became light blue in color; viii) cooling and further washing the solid of impurities by slurrying the solid in portions of N,N-dimethylformamide at room temperature, about 25 degrees, approximately equivalent to about three times blue in color; ix) washing the solid of impurities by slurrying said solid in portions of an organic solvent, such as methanol, acetone, water and the like, and in this embodiment methanol, at room temperature (about 25 degrees) approximately equivalent to about three times the volume of the solid being washed, until the filtrate became light blue in color; x) oven drying the purple solid in the presence of a vacuum or in air at a temperature of from about 25 degrees to about 200 degrees, and, in embodiments at about 70 degrees, for a period of from about 2 hours to about 48 hours and, in embodiments for about 24 hours, thereby resulting in the isolation of a shiny purple solid which was identified as being Type I titanyl phthalocyanine by its X-ray powder diffraction trace.

In still another embodiment, a Type I titanyl phthalocyanine may be prepared by: (i1) reacting a $DI^3$ with a titanium tetra alkoxide such as, for example, titanium tetrabutoxide at a temperature of about 195° C. for about two hours; (ii) filtering the contents of the reaction to obtain a resulting solid; (iii) washing the solid with dimethylformamide (DMF); (iv) washing with four percent ammonium hydroxide; (v) washing with deionized water; (vi) washing with methanol; (vii) reslurrying the washes and filtering; and (viii) drying at about 70° C. under vacuum to obtain a Type I titanyl phthalocyanine.

In a process for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. Generally, the trihaloacetic acid is not limited in any manner. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time such as, for example, for about 30 seconds to about 24 hours, at room temperature. In one embodiment, the Type I titanyl phthalocyanine is dissolved by stirring in the solvent for about one hour at room temperature (i.e., about 25° C). The Type I titanyl phthalocyanine may be dissolved in the solvent in either air or in an inert atmosphere (e.g., argon or nitrogen).

In embodiments the Type I titanyl phthalocyanine is converted to an intermediate titanyl phthalocyanine form prior to conversion to the high sensitivity titanyl phthalocyanine pigment. "Intermediate" in embodiments refers for example, to indicate that the Type Y titanyl phthalocyanine is a separate form prepared in the process prior to obtaining the final desired Type V titanyl phthalocyanine product. To obtain the intermediate form, which is designated as a Type Y titanyl phthalocyanine, the dissolved Type I titanyl phthalocyanine is added to a quenching system comprising an alkyl alcohol and alkylene chloride. Adding the dissolved Type I titanyl phthalocyanine to the quenching system causes the Type Y titanyl phthalocyanine to precipitate. Materials suitable as the alkyl alcohol component of the quenching system include, but are not limited to, methanol, ethanol, and the like. In embodiments, the alkylene chloride component of the quenching system comprises from about one to about six carbon atoms. In one embodiment, the quenching system comprises methanol and methylene chloride. The quenching system comprises an alkyl alcohol to alkylene chloride ratio of from about 1/4 to about 4/1 (v/v). In other embodiments, the ratio of alkyl alcohol to alkylene chloride is from about 1/1 to about 3/1 (v/v). In one embodiment, the quenching system comprises methanol and methylene chloride in a ratio of about 1/1 (v/v). In another embodiment, the quenching system comprises methanol and methylene chloride in a ratio of about 3/1 (v/v). In embodiments, the dissolved Type I titanyl phthalocyanine is added to the quenching system at a rate of from about 1 ml/min to about 100 ml/min, and the quenching system is maintained at a temperature of from about 0 to about −25° C. during quenching. In a further embodiment, the quenching system is maintained at a temperature of from about 0 to about −25° C. for a period of from about 0.1 hour to about 8 hours after addition of the dissolved Type I titanyl phthalocyanine solution.

Following precipitation of the Type Y titanyl phthalocyanine, the precipitates may be washed with any suitable solution, including, for example, methanol, cold deionized water, hot deionized water, and the like. Generally, washing the precipitate will also be accompanied by filtration. A wet cake containing Type Y titanyl phthalocyanine and water is obtained with water content varying from about 30 to about 70 weight percent of the wet cake.

The Type V titanyl phthalocyanine is obtained by treating the obtained intermediate Type Y titanyl phthalocyanine with a halo, such as, for example, monochlorobenzene. The Type Y titanyl phthalocyanine wet cake may be redispersed in monochlorobenzene, filtered and oven-dried at a temperature of from about 60 to about 85° C. to provide the resultant Type V titanyl phthalocyanine. The monochlorobenzene treatment may occur over a period of about one to about 24 hours. In one embodiment, the monochlorobenzene is carried out for a period of about five hours.

A titanyl phthalocyanine obtained in accordance with processes of the present disclosure, which is designated as a Type V titanyl phthalocyanine, exhibits an x-ray powder diffraction spectrum distinguishable from other known titanyl phthalocyanine polymorphs. A Type V titanyl phthalocyanine obtained exhibits an x-ray diffraction spectrum having four characteristics peaks at 9.0°, 9.6°, 24.0°, and 27.2°. A titanyl phthalocyanine prepared by a process in accordance with the present disclosure may have a particle size of from about 10 nm to about 500 nm. Particle size may be controlled or affected by the quenching rate when adding the dissolved Type I titanyl phthalocyanine to the quenching system and the composition of the quenching system.

The charge generation layer may comprise in embodiments single or multiple layers comprising inorganic or organic compositions and the like. Suitable polymeric film-forming binder materials for the charge generating layer and/or charge generating pigment include, but are not limited to, thermoplastic and thermosetting resins, such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, amino resins, phenylene oxide resins, terephthalic acid resins, phenoxy resins, epoxy resins, phenolic resins, polystyrene and acrylonitrile copolymers, polyvinyl chloride, vinylchloride and vinyl acetate copolymers, acrylate copolymers, alkyd resins, cellulosic film formers, poly(amideimide), styrene-butadiene copolymers, vinylidinechloride-vinylchloride copolymers, vinylacetate-vinylidenechloride copolymers, carboxyl-modified vinyl acetate-vinylchloride copolymers, styrene-alkyd resins, polyvinylcarbazole, and mixtures thereof.

The charge-generating component may also contain a photogenerating composition or pigment. The photogenerating composition or pigment may be present in the resinous binder composition in various amounts, ranging from about 5% by volume to about 90% by volume (the photogenerating pigment is dispersed in about 10% by volume to about 95% by volume of the resinous binder); or from about 20% by volume to about 75% by volume (the photogenerating pigment is dispersed in about 25% by volume to about 80% by volume of the resinous binder composition). When the photogenerating component contains photoconductive compositions and/or pigments in the resinous binder material, the thickness of the layer typically ranges from about 0.01 μm to about 10.0 μm, or from about 0.1 μm to about 3 μm. The charge generation layer thickness is often related to binder content, for example, higher binder content compositions typically require thicker layers for photogeneration. Thicknesses outside these ranges may also be selected.

In embodiments, the charge generation layer includes a photoconductive pigment and a thiophosphate.

In embodiments, an imaging member is provided wherein the photoconductive pigment is Type B chlorogallium phthalocyanine and the dopant is zinc dialkyldithiophosphate.

In embodiments, an imaging member is provided wherein the photoconductive pigment is Type V hydroxygallium phthalocyanine and the dopant is zinc dialkyldithiophosphate.

In embodiments, an imaging member is provided wherein the photoconductive pigment is Type IV titanyl phthalocyanine and the dopant is zinc dialkyldithiophosphate.

In embodiments, an imaging member is provided wherein the photoconductive pigment is Type V titanyl phthalocyanine and the dopant is zinc dialkyldithiophosphate.

In embodiments, an imaging member is provided wherein the photoconductive pigment is benzimidazole perylene and the dopant is zinc dialkyldithiophosphate.

In embodiments, an imaging member is provided wherein the photoconductive pigment is benzimidazole terrylene and the dopant is antimony diamyldithiophosphate.

In embodiments, an imaging member is provided wherein the photoconductive pigment is piperidine-modified benzimidazole perylene and the dopant is antimony diamyldithiophosphate.

The thiophosphate material may be provided in any suitable amount. In embodiments, the thiophosphate is present in an amount selected from about 0.1 weight percent to about 40 weight percent based upon the total weight of charge generation layer, or from about 1 weight percent to about 20 weight percent based upon the total weight of charge generation layer.

In embodiments, the thiophosphate is incorporated in the charge generation layer by (1) adding it into an already prepared charge generation layer dispersion; or (2) milling it together with polymeric binder and photoconductive pigment in solvents. For example, in embodiments, the charge generation layer is coated from a charge generation dispersion that is prepared by adding the thiophosphate material into the dispersion of a photoconductive pigment and a polymeric resin, or by ball milling the thiophosphate material, a photoconductive pigment, and a polymeric resin together.

In embodiments, the thiophosphate is substantially completely soluble in a charge generation layer solvent.

Typical charge generation layer solvents comprising, for example, ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, tetrahydrofuran, dioxane, diethyl ether, dimethyl formamide, dimethyl acetamide, butyl acetate, ethyl acetate, methoxyethyl acetate, among others.

As with the various other layers described herein, the charge generation layer can be applied to underlying layers by any desired or suitable method. Any suitable technique may be employed to mix and thereafter apply the photogenerating layer coating mixture with typical application techniques including, but not being limited to, spraying, dip coating, roll coating, wire wound rod coating, die coating, slot coating, slide coating, and the like. Drying, as with the other layers herein, can be effected by any suitable technique, such as, but not limited to, oven drying, infrared radiation drying, air drying, and the like.

The thickness of the imaging device typically ranges from about 2 μm to about 100 μm; from about 5 μm to about 50 μm, or from about 10 μm to about 30 μm. The thickness of each layer will depend on how many components are contained in that layer, how much of each component is desired in the layer, and other factors familiar to those in the art. In general, the ratio of the thickness of the charge transport layer to the charge generation layer can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, i.e., charge generation layer, and allows these holes to be transported through itself to selectively discharge a surface charge on the surface of the active layer.

In embodiments, the at least one charge transport layer comprises from about 1 to about 7 layers. For example, in embodiments, the at last one charge transport layer comprises a top charge transport layer and a bottom charge transport layer, wherein the bottom layer is situated between the charge generation layer and the top layer.

Aryl amines selected for the charge, especially hole transport layers, which generally are of a thickness of from about 5 microns to about 75 microns, and more specifically, of a thickness of from about 10 microns to about 40 microns, include molecules of the following formula (10)

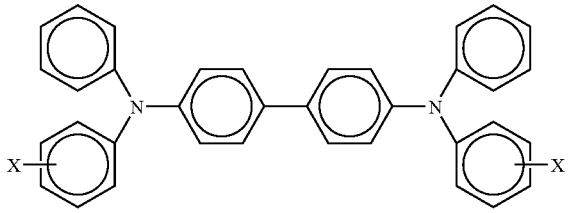

wherein X is alkyl, alkoxy, aryl, a halogen, or mixtures thereof, and in embodiments alkyl is selected from the group consisting of from about 1 to about 10 carbon atoms.

molecules of the following formula (11)

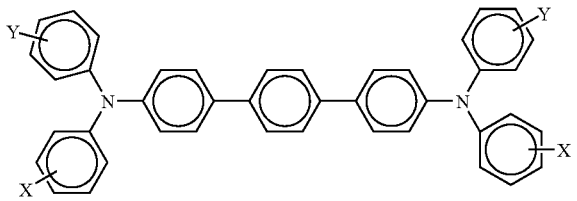

wherein X and Y are independently alkyl, alkoxy, aryl, a halogen, or mixtures thereof, alkyl and alkoxy contain for example from 1 to about 25 carbon atoms, and more specifically from 1 to about 10 carbon atoms, such as methyl, ethyl, propyl, butyl, pentyl, and the corresponding alkoxides, aryl can contain from 6 to about 36 carbon atoms, such as phenyl, and the like, halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and optionally mixtures and combinations thereof, and the like. Other known charge transport layer molecules can be selected, reference for example, U.S. Pat. Nos. 4,921,773 and 4,464,450, the disclosures of each of which are totally incorporated herein by reference. In embodiments, the charge transport layer comprises aryl amine mixtures.

In embodiments, the charge transport layer contains an antioxidant optionally comprised of, for example, a hindered phenol or a hindered amine.

Examples of components or materials optionally incorporated into the charge transport layers or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX™ 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX™ 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN™ 144 and 622LD (available from Ciba Specialties Chemicals), MARK™ LA57, LA67, LA62, LA68 and LA63 (available from Asahi Denka Co., Ltd.), and SUMILIZER™ TPS (available from Sumitomo Chemical Co., Ltd.); thioether antioxidants such as SUMILIZER™ TP-D (available from Sumitomo Chemical Co., Ltd.); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl) phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Optionally, an overcoat layer can be employed to improve resistance of the photoreceptor to abrasion. An optional anticurl back coating may further be applied to the surface of the substrate opposite to that bearing the photoconductive layer to provide flatness and/or abrasion resistance where a web configuration photoreceptor is desired. These overcoating and anticurl back coating layers are well known in the art, and can comprise for example thermoplastic organic polymers or inorganic polymers that are electrically insulating or slightly semiconductive. In embodiments, overcoatings are continuous and have a thickness of less than about 10 microns, although the thickness can be outside this range. The thickness of anticurl backing layers is selected in embodiments sufficient to balance substantially the total forces of the layer or layers on the opposite side of the substrate layer.

Various exemplary embodiments encompassed herein include a method of imaging which includes generating an electrostatic latent image on an imaging member, developing a latent image, and transferring the developed electrostatic image to a suitable substrate.

Further embodiments encompassed within the present disclosure include methods of imaging and printing with the photoresponsive devices illustrated herein. Various exemplary embodiments include methods including forming an electrostatic latent image on an imaging member; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto. In various exemplary embodiments in which the embodiment is used in a printing mode, various exemplary imaging methods include forming an electrostatic latent image on an imaging member by use of a laser device or image bar; developing the image with a toner composition including, for example, at least one thermoplastic resin, at least one colorant, such as pigment, at least one charge additive, and at least one surface additive; transferring the image to a necessary member, such as, for example any suitable substrate, such as, for example, paper; and permanently affixing the image thereto.

In a selected embodiment, an image forming apparatus for forming images on a recording medium comprises a) a photoreceptor member having a charge retentive surface to receive an electrostatic latent image thereon, wherein said photoreceptor member comprises a metal or metallized substrate, a charge generation layer comprising photoconductive pigment and a thiophosphate material, and a charge transport layer comprising charge transport materials dispersed therein; b) a development component to apply a developer material to said charge-retentive surface to develop said electrostatic latent image to form a developed image on said charge-retentive surface; c) a transfer component for transferring said developed image from said charge-retentive surface to another member or a copy substrate; and d) a fusing member to fuse said developed image to said copy substrate.

In embodiments, imaging members are provided wherein the charge generation layer is more sensitive than an imaging member having a comparable charge generation layer that is free of the thiophosphate material. For example, in embodiments, an imaging member herein provides a charge generation layer that is about 5% to about 30% more sensitive than charge generation layer of a comparable device not comprising the present sensitized charge generation layer.

In embodiments, an imaging member having a charge generation layer comprising a thiophosphate material exhibits low imaging ghosting than an imaging member having a comparable charge generation layer that is free of the thiophosphate.

EXAMPLES

The following Examples are being submitted to further define various species of the present disclosure. These Examples are intended to be illustrative only and are not intended to limit the scope of the present disclosure. Also, parts and percentages are by weight unless otherwise indicated.

Comparative Example 1 and Example 1 were prepared as follows. Two multilayered photoreceptors of the rigid drum design were fabricated by conventional coating technology with an aluminum drum of 34 millimeters in diameter as the substrate. The two drum photoreceptors contained the same undercoat layer and charge transport layer. The only difference is that Comparative Example 1 contained a charge generation layer (CGL) comprising a film forming polymer binder and a photoconductive component, chlorogallium phthalocyanine; Example 1 contained the same layers as Comparative Example 1 except that zinc dialkyldithiophosphate (ZDDP) was incorporated into the charge generation layer in Example 1.

The undercoat layer is a three-component undercoat which coating solution was prepared as follows: zirconium acetylacetonate tributoxide (ORGATICS™ ZC-540, available from Matsumoto Kosho Co., Japan, 35.5 grams), γ-aminopropyltriethoxysilane (4.8 grams) and polyvinyl butyral S-LEC™ BM-S (degree of polymerization=850, mole percent of vinyl butyral>=70, mole percent of vinyl acetate=4 to 6, mole percent of vinyl alcohol=25, available from Sekisui Chemical Co., Ltd., Tokyo, Japan, 2.5 grams) was dissolved in n-butanol (52.2 grams). The coating solution was coated via a ring coater, and the layer was pre-heated at 59° C. for 13 minutes, humidified at 58° C. (dew point=54° C.) for 17 minutes, and dried at 135° C. for 8 minutes. The thickness of the undercoat layer was approximately 1.3 μm.

Preparation of CGL Dispersion for Comparative Example 1: 2.7 grams of Type B chlorogallium phthalocyanine (ClGaPc) pigment was mixed with about 2.3 grams of polymeric binder VMCH (Dow Chemical), 30 grams of xylene and 15 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 5.8 weight percent with a mixture of xylene/n-butyl acetate=2/1 (weight/weight). The ClGaPc charge generation layer dispersion was applied on top of the above undercoat layer. The thickness of the charge generation layer was approximately 0.2 μm.

Preparation of CGL Dispersion for Example 1: To the above CGL dispersion (Comparative Example 1) was added 0.25 grams of zinc dialkyldithiophosphate (ZDDP ELCO™ 103, wherein alkyl is mixture of primary and secondary propyl, butyl and pentyl), commercially available from Elco Corporation, and the resulting dispersion was allowed to mix for at least 2 hours. The ClGaPc charge generation layer dispersion was applied on top of the above undercoat layer. The thickness of the charge generation layer was approximately 0.2 μm.

Subsequently, a 30-μm charge transport layer was coated on top of the charge generation layer, respectively, which coating dispersion was prepared as follows: N,N'-diphenyl-N,N-bis(3-methylphenyl)-1,1'-biphenyl-4,4'-diamine (5.38 grams), a film forming polymer binder PCZ 400 [poly(4,4'-dihydroxy-diphenyl-1-1-cyclohexane, $M_w$=40,000)] available from Mitsubishi Gas Chemical Company, Ltd. (7.13 grams), and PTFE POLYFLON L-2 microparticle (1 gram) available from Daikin Industries were dissolved/dispersed in a solvent mixture of 20 grams of tetrahydrofuran (THF) and 6.7 grams of toluene via CAVIPRO 300 nanomizer (Five Star technology, Cleveland, Ohio). The charge transport layer was dried at about 120° C. for about 40 minutes.

The above prepared photoreceptor devices were tested in a scanner set to obtain photo-induced discharge cycles, sequenced at one charge-erase cycle followed by one charge-expose-erase cycle, wherein the light intensity was incrementally increased with cycling to produce a series of photo-induced discharge characteristic curves from which the photosensitivity and surface potentials at various exposure intensities were measured. Additional electrical characteristics were obtained by a series of charge-erase cycles with incrementing surface potential to generate several voltages versus charge density curves. The scanner was equipped with a scorotron set to a constant voltage charging at various surface potentials. The devices were tested at surface potentials of 700 volts with the exposure light intensity incrementally increased by means of regulating a series of neutral density filters; the exposure light source was a 780-nanometer light emitting diode. The aluminum drum was rotated at a speed of 55 revolutions per minute to produce a surface speed of 277 millimeters per second or a cycle time of 1.09 seconds. The xerographic simulation was completed in an environmentally controlled light tight chamber at ambient conditions (40 percent relative humidity and 22° C.). Two photo-induced discharge characteristic (PIDC) curves were generated. The PIDC results are summarized in Table 1. Incorporation of zinc dialkyldithiophosphate into charge generation layer increased ClGaPc photosensitivity (initial slope of the PIDC) by about 15%, and decreased V(2.8 ergs/cm$^2$), which represents the surface potential of the device when exposure is 2.8 ergs/cm$^2$, about 120V.

The two devices were acclimated for 24 hours before testing in J zone (70° F. and 10% humidity) for ghosting test. Print test was done in Copeland Work centre Pro 3545 using K station at tp=500 print counts. Run-up from t=0 to tp=500 print counts for the device was done in one of the CYM color stations. Ghosting levels were measured against TSIDU SIR scale (from Grade 1 to Grade 6). The smaller the ghosting grade (absolute value), the better the print quality. The ghosting results are also summarized in Table 1, and negative ghosting grades indicate negative ghosting. Incorporation of zinc dialkyldithiophosphate into the charge generation layer reduced ghosting by more than one grade.

TABLE 1

| | Sensitivity (Vcm$^2$/erg) | V (2.8 ergs/cm$^2$) (V) | J zone ghosting (t = 0 print) | J zone ghosting (t = 500 prints) |
|---|---|---|---|---|
| Comp. Ex. 1 | −202 | 271 | −3.5 | −5 |
| Example 1 | −239 | 149 | 0 | −3.5 |

Comparative Example 2 and Examples 2 were prepared as follows. Two multilayered photoreceptors of the rigid drum design were fabricated by conventional coating technology with an aluminum drum of 34 millimeters in diameter as the substrate. The two drum photoreceptors contained the same undercoat layer and charge transport layer, and are same as described in the above two examples, however, charge generation layers are different. Comparative Example 2 contained a charge generation layer (CGL) comprising a film forming polymer binder and a photoconductive component, hydroxygallium phthalocyanine; Example 2 contained the same layers as Comparative Example 2 except that ZDDP was incorporated into the charge generation layer.

Preparation of CGL Dispersion for Comparative Example 2: Three grams of Type V hydroxygallium phthalocyanine (HOGaPc) pigment was mixed with about 2.0 grams of polymeric binder VMCH (Dow Chemical), 45 grams of n-butyl acetate. The mixture was milled in an ATTRITOR mill with about 200 grams of 1 mm Hi-Bea borosilicate glass beads for about 3 hours. The dispersion was filtered through a 20-μm nylon cloth filter, and the solid content of the dispersion was diluted to about 5.8 weight percent with n-butyl acetate. The HOGaPc charge generation layer dispersion was applied on top of the above undercoat layer. The thickness of the charge generation layer was approximately 0.2 μm.

Preparation of CGL Dispersion for Example 2: To the above CGL dispersion (Comparative Example 2) was added 0.40 grams of zinc dialkyldithiophosphate (ZDDP ELCO™ 103, wherein alkyl is mixture of primary and secondary propyl, butyl and pentyl), commercially available from Elco Corporation, and the resulting dispersion was allowed to mix for at least 2 hours. The HOGaPc charge generation layer dispersion was applied on top of the above undercoat layer. The thickness of the charge generation layer was approximately 0.2 μm.

The photoreceptors were tested for PIDC using the same procedure described as above. Two photo-induced discharge characteristic (PIDC) curves were generated. The PIDC results are summarized in Table 2. Incorporation of zinc dialkyldithiophosphate into charge the generation layer increased HOGaPc photosensitivity (initial slope of the PIDC) by about 10%, and decreased V(2.0 ergs/cm$^2$), which represents the surface potential of the device when exposure is 2.0 ergs/cm$^2$, about 60V.

TABLE 2

| | Sensitivity (Vcm$^2$/erg) | V (2.0 ergs/cm$^2$) (V) |
|---|---|---|
| Comp. Ex. 2 | −390 | 140 |
| Example 2 | −427 | 76 |

Multilayered photoreceptors of the flexible belt design are fabricated by conventional coating technology with a biaxially oriented polyethylene naphthalate substrate (KALEDEX™ 2000) having a thickness of 3.5 mils as the substrate. All the photoreceptors contain the same blocking layer, adhesive layer, and charge transport layers. The difference is that Comparative Example 3 contains no ZDDP in the charge generation layer. Comparative Example 3 is prepared comprising a charge generation layer (CGL) comprising a film forming polymer binder and a photoconductive component, benzimidazole perylene. Example 3 contains the same layers as Comparative Example 3 except that ZDDP is incorporated into the CGL.

The lower layers were prepared by providing a 0.02 micrometer thick titanium layer coated (the coater device) on a biaxially oriented polyethylene naphthalate substrate (KALEDEX™ 2000) having a thickness of 3.5 mils, and applying thereon, with a gravure applicator, a blocking layer solution containing 50 grams of 3-amino-propyltriethoxysilane, 41.2 grams of water, 15 grams of acetic acid, 684.8 grams of denatured alcohol, and 200 grams of heptane. This layer was then dried for about 1 minute at 120° C. in the forced air dryer of the coater. The resulting blocking layer had a dry thickness of 500 Angstroms. An adhesive layer was then prepared by applying a wet coating over the blocking layer, using a gravure applicator, and which adhesive contains 0.2 percent by weight based on the total weight of the solution of copolyester adhesive (ARDEL D100™ available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

Preparation of CGL Dispersion for Comparative Example 3 0.45 grams of the known polycarbonate LUPILON 200™ (PCZ-200) or POLYCARBONATE Z™, weight average molecular weight of 20,000, available from Mitsubishi Gas Chemical Corporation, is mixed with 50 milliliters of tetrahydrofuran (THF) into a 4 ounce glass bottle. To this solution are added 2.4 grams of benzimidazole perylene and 300 grams of ⅛-inch (3.2 millimeters) diameter stainless steel shot. This mixture is then placed on a ball mill for 8 hours. Subsequently, 2.25 grams of PCZ-200 are dissolved in 46.1 grams of tetrahydrofuran, and added to the benzimidazole perylene dispersion. This slurry is then placed on a shaker for 10 minutes. The resulting dispersion is, thereafter, applied to the above adhesive interface with a Bird applicator to form a charge generation layer having a wet thickness of 0.50 mil. A strip about 10 millimeters wide along one edge of the substrate web bearing the blocking layer and the adhesive layer is deliberately left uncoated by any of the charge generation layer material to facilitate adequate electrical contact by the ground strip layer that was applied later. The charge generation layer is dried at 120° C. for 1 minute in a forced air oven to form a dry charge generation layer having a thickness of 1.0 micrometer.

Preparation of CGL Dispersion for Example 3: To the above CGL dispersion (Comparative Example 3) is added 0.50 grams of zinc dialkyldithiophosphate (ZDDP ELCO™ 103, wherein alkyl is mixture of primary and secondary propyl, butyl and pentyl), commercially available from Elco Corporation, and the resulting dispersion is allowed to mix for at least 2 hours. The resulting benzimidazole perylene charge generation layer dispersion is applied on top of the above blocking layer. The thickness of the charge generation layer is approximately 1.0 μm.

The resulting imaging member web was then overcoated with a two-layer charge transport layer. Specifically, the charge generation layer was overcoated with a charge transport layer (the bottom layer) in contact with the charge generation layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine, and MAKROLON 5705®, a known polycarbonate resin having a molecular weight average of from about 50,000 to 100,000, commercially available from Farbenfabriken Bayer A.G. The resulting mixture was then dissolved in methylene chloride to form a solution containing 15 percent by weight solids. This solution was applied on the charge generation layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process the humidity was equal to or less than 15 percent.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

The invention claimed is:

1. An imaging member comprising:

a substrate;

thereover a charge generation layer comprising zinc dialkyldithiophosphate; and at least one charge transport layer positioned on the charge generation layer.

2. The imaging member of claim 1, wherein the thiophosphate is selected from the group consisting of materials having the following structures (1)

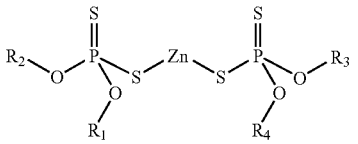

(2)

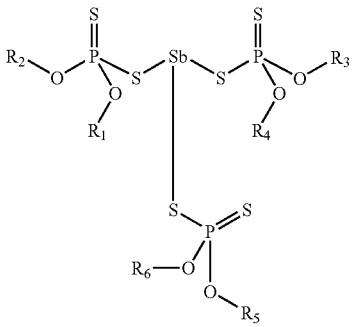

wherein $R_1$, $R_2$, $R_3$, $R_4$, $R_5$ and $R_6$ are each independently selected form the group consisting of hydrogen, an alkyl group having from about 1 to about 20 carbon atoms, a cycloalkyl group having form about 6 to about 26 carbon atoms, aryl, aklylaryl, arylaklyl, or a hydrocarbyl group having form about 3 to about 20 carbon atoms and containing an ester, ether, alcohol or carboxyl group, a straight chained alkyl group having from about 2 to about 18 carbon atoms, a branched alkyl group having from about 2 to about 18 carbon atoms, or mixtures or combinations thereof.

3. The imaging member of claim 1, wherein the thiophosphate is present in an amount selected from about 0.1 weight percent to about 40 weight percent based upon the total weight of the charge generation layer.

4. The imaging member of claim 1, wherein the charge generation layer comprises a member selected from the group consisting of rylenes, benzimidazole perylene, metal phthalocyanines, metal-free phthalocyanine, vanadyl phthalocyanine, hydroxygallium phthalocyanine, titanyl phthalocyanine, chlorogallium phthalocyanine, and mixtures and combinations thereof.

5. The imaging member of claim 4, wherein the rylene pigment is selected from the group consisting of benzimidazole perylene (BZP) having the formula of (4)

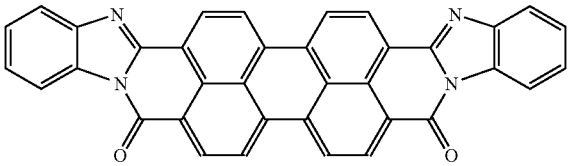

benzimidazole terrylene (BZT) having the formula of (5)

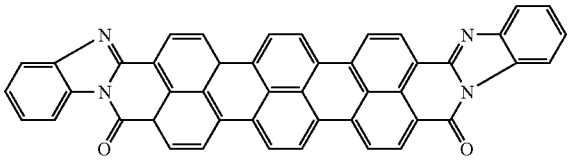

benzimidazole quaterrylene (BZQ) having the formula of (6)

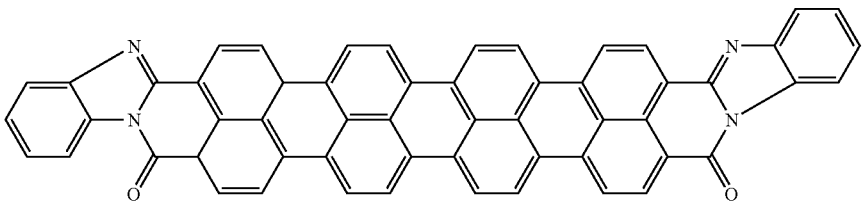

piperidine-modified benzimidazole terrylene (PBZT) having the formula of (7)

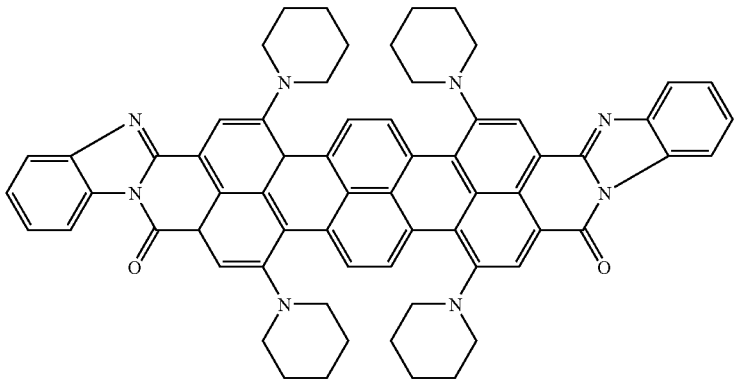

piperidine-modified benzimidazole perylene (PBZP) having the formula of (8)

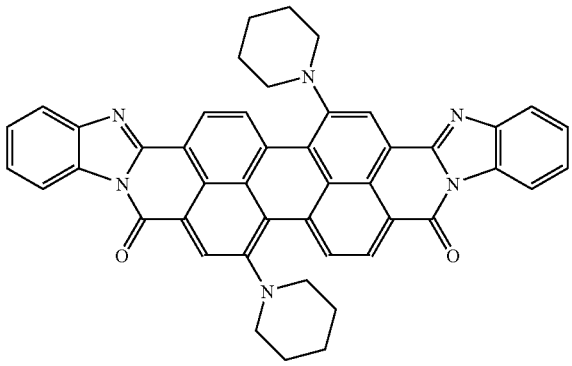

and piperidine-modified benzimidazole quatenylene (PBZQ) having the formula of (9)

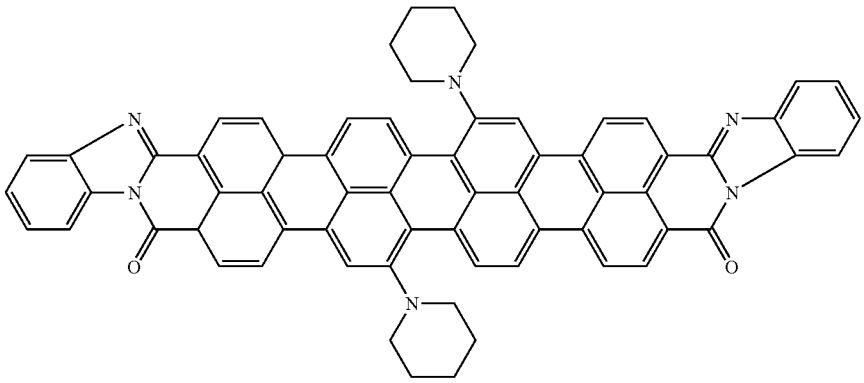

and mixtures and combinations thereof.

6. The imaging member of claim 1, wherein the charge transport layer is comprised of aryl amine molecules, and which aryl amines are of the formula (10)

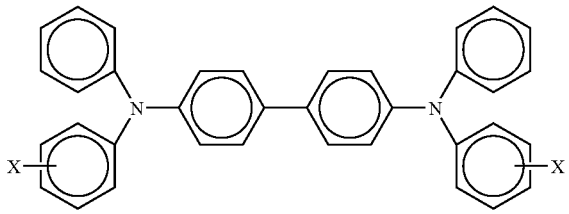

wherein X is selected from the group consisting of alkyl, alkoxy, aryl and halogen, and said alkyl contains from about 1 to about 10 carbon atoms.

7. The imaging member of claim 1 wherein the charge transport layer is comprised of aryl amine molecules, and which aryl amines are of the formula (11)

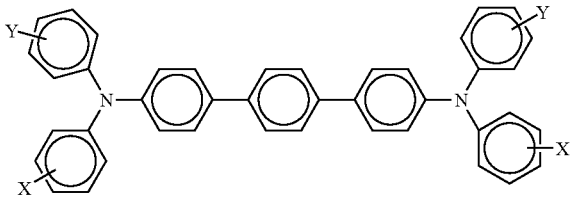

wherein each X and Y is independently selected from the group consisting of alkyl, alkoxy, aryl and halogen.

8. The imaging member of claim 6, wherein each alkoxy and alkyl contains from about 1 to about 10 carbon atoms; aryl contains from 6 to about 36 carbon atoms;

and halogen is chloride, bromide, fluoride, or iodide.

9. The imaging member of claim 6, wherein said aryl amine is selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, and N,N'-diphenyl-N,N'-bis(3-chlorophenyl)-[p-terphenyl]-4,4"-diamine, N,N'-diphenyl-N,N-bis(3-methylphenyl)-1,1'-biphenyl-4,4'-diamine and optionally mixtures thereof.

10. The imaging member of claim 1, wherein the at least one charge transport layer is from about 1 to about 7 layers.

11. The imaging member of claim 1 wherein the at least one charge transport layer is comprised of a top charge transport layer and a bottom charge transport layer and wherein the bottom layer is situated between the charge generation layer and the top layer.

12. A process for fabricating the imaging member of claim 1 comprising:

providing a substrate;

forming an optional undercoat layer on the substrate;

forming an optional adhesive layer situated on the substrate or on the optional blocking layer;

forming a sensitized charge generation layer comprising a thiophosphate on the substrate, on the optional undercoat layer, or on the optional adhesive layer; and forming at least one charge transport layer on the charge generation layer.

13. The process of claim 12, wherein the thiophosphate is selected from the group consisting of materials having the following structures (1)

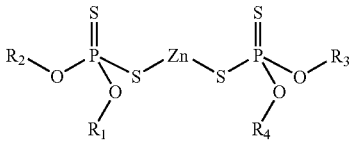

-continued (2)

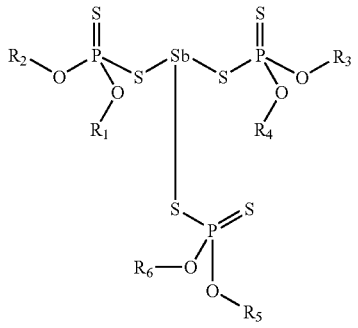

wherein $R_1$, $R_2$, $R_3$, $R_4$, $R_5$ and $R_6$ are each independently selected form the group consisting of hydrogen, an alkyl group having from about 1 to about 20 carbon atoms, a cycloalkyl group having form about 6 to about 26 carbon atoms, aryl, aklylaryl, arylaklyl, or a hydrocarbyl group having form about 3 to about 20 carbon atoms and containing an ester, ether, alcohol or carboxyl group, a straight chained alkyl group having from about 2 to about 18 carbon atoms, a branched alkyl group having from about 2 to about 18 carbon atoms, and mixtures and combinations thereof.

14. The process of claim 12, wherein the thiophosphate is present in an amount selected from about 0.1 weight percent to about 40 weight percent based upon the total weight of the charge generation layer.

15. An imaging member comprising:

a substrate;

a charge generation layer positioned on the substrate, wherein the charge generation layer comprises zinc dialkyldithiophosphate; and;

at least one charge transport layer positioned on the charge generation layer, wherein the charge transport layer comprises N,N'-diphenyl-N,N-bis(3-methylphenyl)-1,1'-biphenyl-4,4'-diamine.

16. An image forming apparatus including the imaging member of claim 1 for forming images on a recording medium comprising:

a) a photoreceptor member having a charge retentive surface to receive an electrostatic latent image thereon, wherein said photoreceptor member comprises a metal or metallized substrate, a charge generation layer, and at least one charge transport layer; wherein the charge generation layer comprises a thiophosphate;

b) a development component to apply a developer material to said charge-retentive surface to develop said electrostatic latent image to form a developed image on said charge-retentive surface;

c) a transfer component for transferring said developed image from said charge-retentive surface to another member or a copy substrate; and d) a fusing member to fuse said developed image to said copy substrate.

* * * * *